United States Patent [19]

Sorensen et al.

[11] Patent Number: 5,038,944

[45] Date of Patent: Aug. 13, 1991

[54] MERCHANDISE WALL DISPLAY

[75] Inventors: Gerald R. Sorensen, Elgin; Raymond J. Gradecki, Mundelein; Joseph A. Brhel, Des Plaines, all of Ill.

[73] Assignee: NCM International, Inc., Arlington Heights, Ill.

[21] Appl. No.: 585,249

[22] Filed: Sep. 19, 1990

[51] Int. Cl.[5] ..... A47F 7/00

[52] U.S. Cl. ..... 211/59.1; 211/90

[58] Field of Search ..... 211/59.1, 57.1, 90, 211/135; 248/220.4, 220.3, 221.1

[56] References Cited

U.S. PATENT DOCUMENTS

| | | | |
|---|---|---|---|
| 4,194,637 | 3/1980 | Edson | 211/59.1 X |
| 4,815,618 | 3/1989 | Borick et al. | 211/59.1 |
| 4,909,397 | 3/1990 | Huber | 211/59.1 X |

*Primary Examiner*—Alvin C. Chin-Shue

*Assistant Examiner*—Sarah Lechok

*Attorney, Agent, or Firm*—Wallenstein, Wagner & Hattis

[57] ABSTRACT

A display rack for displaying and dispensing windshield wipers contained in elongated individual containers having a mounting hole at one end is disclosed. The display rack is configured as a one-piece element having a wall-mounting back portion and a top shelf extending forwardly from the top of the back portion. Forwardly extending L-shaped hangers for hanging the containers are supported by insertion into apertures in a pair of horizontal rails extending laterally along a lower portion of the back portion. Alignment of the individual hangers into a parallel forwardly extending array is provided by alignment extensions disposed on the upper rail which nestingly alignigly receive portions of the forwardly extending hangers. Suitable integral extension webs joining the back portion and the rails add strength to the assembly.

3 Claims, 2 Drawing Sheets

MERCHANDISE WALL DISPLAY

TECHNICAL FIELD

The technical field of the invention is merchandise display systems for displaying and dispensing articles for sale.

BACKGROUND OF THE INVENTION

Merchandise display racks for dispensing automotive products, and in particular windshield wiper blades and filler replacements are designed for advertising, storing and dispensing purposes. Because of the many types of windshield wiper blades which must be carried in inventory, not only should such merchandising displays be capable of accommodating a heavy load, as for example 80 pounds of product, but the product should also be readily removable from the display by a purchaser. Additionally, the purchaser typically does not know the manufacturer's inventory number or manufacturer's serial number of the blade, but merely the make, model and model year of his or her vehicle. Accordingly, it is desirable to provide some form of cross-reference directory which will inform the purchaser or sales personnel which blade is to be supplied. Such a directory should be mounted in close proximity to the merchandise display, and preferably in such a manner so as not to be physically separated therefrom, since such items may readily be lost. Because of cost considerations, furthermore it is desirable that dispensing drawers not be used. Finally, any such display must be readily assembled, and economically manufacturable.

SUMMARY OF THE INVENTION

According to the invention, a display rack for windshield wipers contained in elongated individual containers having a mounting hole at one end is provided. The display rack is configured as a downwardly extending generally plate-shaped rectangular back portion for mounting against a wall and integral with a forwardly downwardly extending shelf portion joining at the rear portion thereof with a top portion of the back portion. The shelf portion is used principally as a support for descriptive literature or directories. A plurality of diagonally disposed struts are provided, each affixed at one end to a forward face of the back portion and at the other to an under surface of said shelf portion. Parallel upper and lower laterally disposed forwardly extending rails are provided integral with said back portion. The upper rail has a plurality of vertically oriented upper apertures passing therethrough and disposed along the length of the upper rail proximate to the juncture of the upper rail and the back portion. The lower rail has a corresponding plurality of vertically oriented lower apertures passing therethrough, each vertically aligned with a different one of the upper rail apertures. The upper and lower apertures are configured to acceptingly accommodate inserted lower ends of forwardly extending L-shaped product hangers. The upper rail further has a plurality of integral forwardly extending alignment protrusions on its upper surface for nestingly aligningly engaging inserted hangers so as to align the hangers to extend parallel forward and away from the back portion. Reinforcing webs integral with the back portion and joining the two rails lend requisite strength to the structure to support at least 80 pounds of product for display.

Other advantages and aspects of the invention will become apparent upon making reference to the specification, claims, and drawings to follow.

DESCRIPTION OF THE INVENTION

Figure 1:
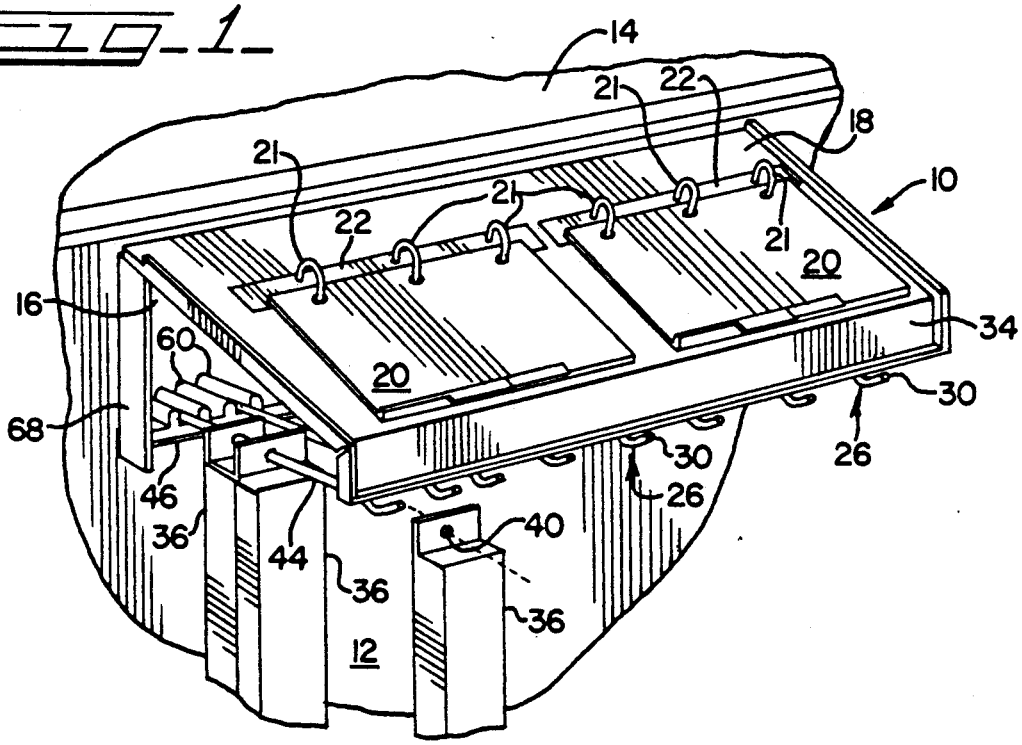
FIG. 1 is a perspective view of a wall display assembly configured for merchandising of windshield wiper blades and blade refills in individual packages.
Figure 2:
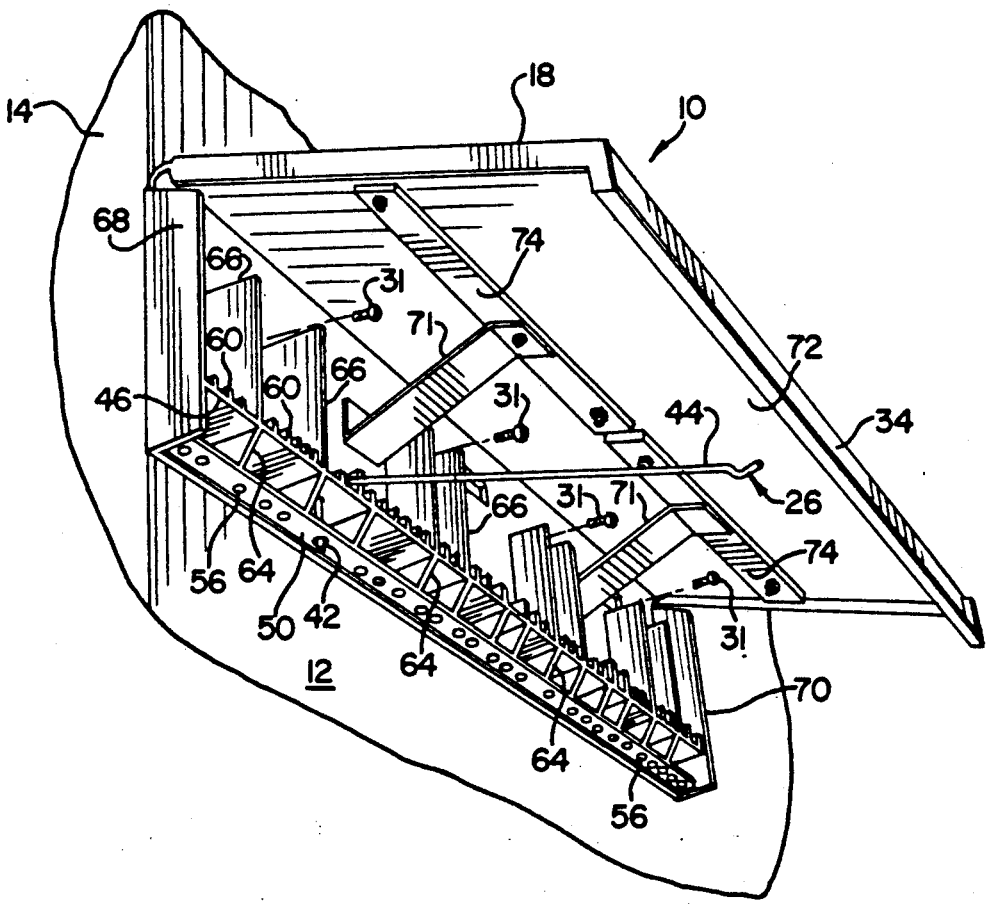
FIG. 2 is a perspective view similar to that of FIG. 1 but seen from generally below and to one side.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Referring now to FIGS. 1–5, and initially in particular to FIG. 1, a wall display assembly or header 10 is shown adapted for mounting as to a peg board 12 affixed to a wall 14. The display assembly 10 includes a wall-mountable back panel 16 having a generally planar rear surface integrally conjoined at the top to an outwardly and downwardly forwardly extending shelf 18 supporting merchandising or directory type flip charts 20 secured to the upper surface of the shelf 18 by means of rings 21. The rings 21 are captively secured to ring retaining members 22 secured within shelf recesses 23 by screws 24 (see also FIG. 4).

A plurality of product display hangers 26 are mounted to the back panel 16, and are configured as generally rod shaped elements having forward ends 30 emerging just below a downwardly depending front face 34 of the shelf 18. Each hanger 26 may accommodate a number of blade or blade refill display packages 36 having hook-engaging apertures 40 at the upper ends thereof. The back panel 16 is secured to the back board 12 by screws 31 passing through apertures (not shown) in the back panel 16.

Figure 3:
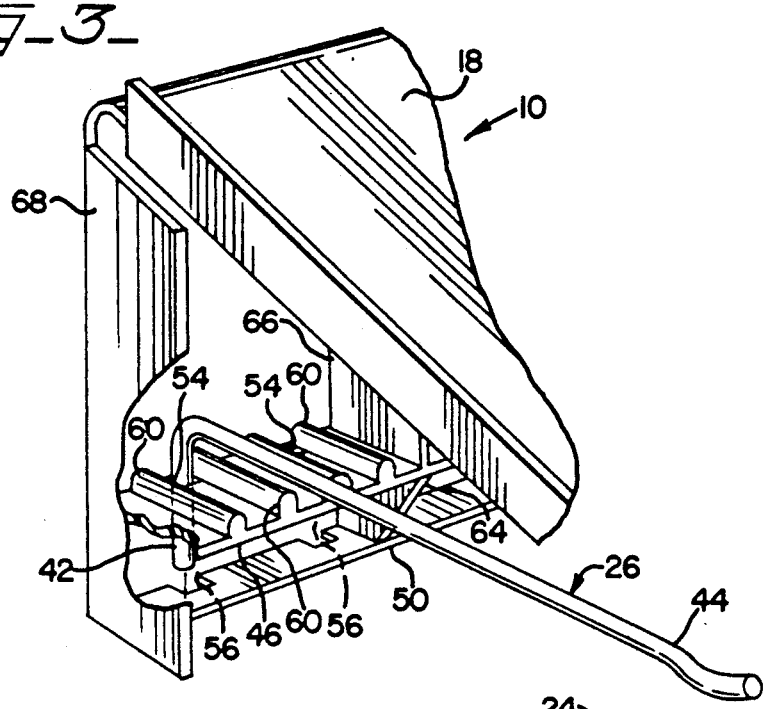
FIG. 3 is a partially cutaway view of a portion of one end of the display assembly as shown in FIG. 1 and showing details of a hanger attachment.
Figure 4:
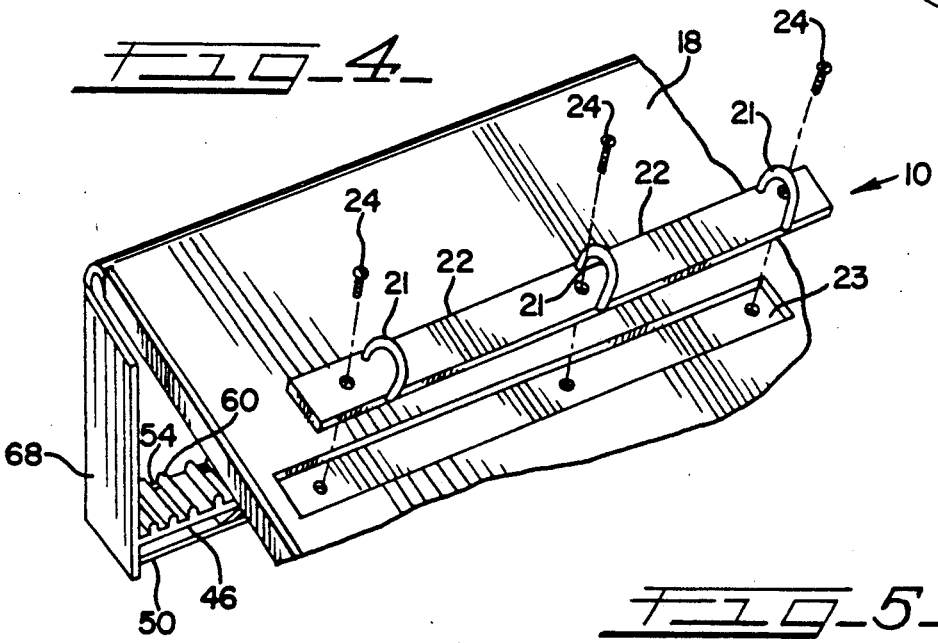
FIG. 4 is a partial perspective view on an upper portion of the wall display assembly of FIG. 1 showing assembly of a flip chart holder.
Figure 5:
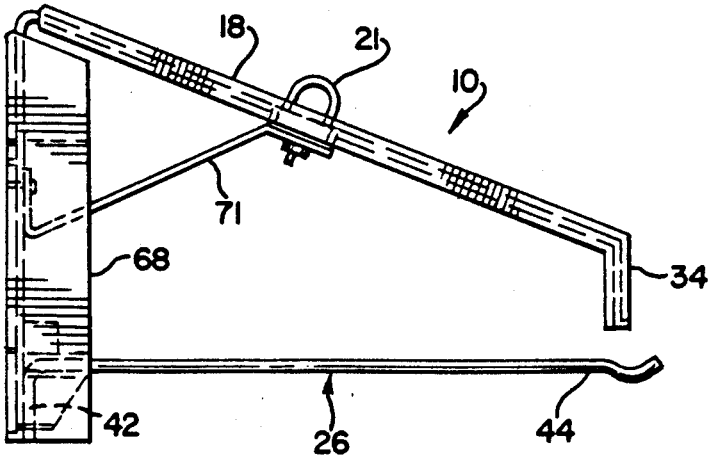
FIG. 5 is a side elevational view of the display assembly shown in FIG. 1.

With particular reference to FIG. 3, the product hangers 26 are generally L-shaped elements having downwardly depending rear portions 42 and forwardly extending front portions 44. Integral with the back panel 16 are upper and lower rails 46,50 extending the width of the back panel 16 and configured to receive the rear portions 42 of the inserted hangers 26. Particularly, pairs of vertically aligned upper and lower apertures 54,56, respectively (see FIGS. 2 and 3), are provided in the upper and lower rails 46,50 and are configured to accept inserted rear portions 12 of the hangers 26.

The upper rail 46 has a pair of forwardly extending upstanding integral ribs 60 disposed on either side of each of the upper apertures 54 to nestingly receive an interior portion of the hanger front portion 44 to align the hangers 26 to extend parallel outwardly from and perpendicular to the back panel 16.

It is desirable that the wall display assembly 10 be capable of storing a considerable weight of merchandise, preferably of the order of 80 pounds or so. To this extent a plurality of planar integral vertically disposed reinforcing webs 64 are provided between the upper and lower rails 46,50. Additionally, integral planar upwardly extending reinforcing members 66 are provided extending upwardly from the upper rail 46 on either side of the mounting screws, and extending preferably therebeyond. Additional stiffness is imparted to the structure by forwardly extending end walls 68,70 integral with the back panel 16 integrally joining the outer ends of the upper and lower rails 46,50 respectively.

Additional support for the shelf 18 is provided by a pair diagonally disposed metal struts affixed 71 at one end, as by screws (not shown) to the forward surface of the back panel 16 at one end, and at the other end to a lower surface 72 of the shelf 18, preferably at lower faces 74 of the recesses 27.

The shelf 18, back panel 16, the rails 46,50, the ribs 60—60, the webs 64, and the reinforcing member 66 are all integrally molded of a plastic such as styrene having a thickness of approximately 0.08 inches. The resulting structure has proven to be capable of safely supporting 80 pounds of product loaded on the hangers 26.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. A display rack for windshield wipers contained in elongated individual containers having a container mounting hole at one end thereof, said rack comprising:

a downwardly extending generally plate-shaped rectangular back portion for mounting against a wall, said back portion including a top portion and a forward face;

a forwardly downwardly extending shelf portion having an under surface and a rear portion integrally joined with said top portion of said back portion;

a plurality of diagonally disposed struts, each of said struts affixed at one end thereof to said forward face of said back portion and at the other end to said under surface of said shelf portion;

a plurality of generally L-shaped hangers having a first and second generally linear sections conjoined together at a juncture point, said first section being configured for passage through said container mounting holes;

a first laterally disposed forwardly extending rail integral with said forward face of said back portion having upper and lower surfaces, said first rail having a first plurality of vertically oriented apertures passing therethrough and disposed along the length of said first rail proximate to the juncture of said first rail and said back portion, said first plurality of apertures being configured to acceptingly accommodate an inserted said second linear section of said hanger, said first rail having a plurality of forwardly extending alignment protrusions on the upper surface thereof for nestingly aligningly engaging regions of said first linear sections of said inserted hangers so as to align said first linear sections to extend parallel forward and away from said back portion.

2. The display rack of claim 1 including a second laterally disposed forwardly extending rail integral with said forward face of said back portion having upper and lower surfaces and mounted parallel to and below said first rail, said second rail having a corresponding second plurality of vertically oriented apertures passing therethrough each vertically aligned with a different one of said upper rail apertures and configured to acceptingly accommodate an inserted said second linear section of a hanger.

3. The display rack of claim 2 including a first plurality of reinforcing webs integrally joining portions of said forward face of said back portion, said lower surface of said first rail, and said upper surface of said second rail, and a second plurality of reinforcing webs integrally joining portions of said forward face of said back portion and said upper surface of said first rail.

* * * * *